US007121250B2

(12) United States Patent
Yokoyama

(10) Patent No.: US 7,121,250 B2
(45) Date of Patent: Oct. 17, 2006

(54) DIESEL ENGINE OIL DILUTION MANAGING DEVICE

(75) Inventor: Jin Yokoyama, Hino (JP)

(73) Assignee: Nissan Motor Co., Ltd., Yokohama (JP)

( * ) Notice: Subject to any disclaimer, the term of this patent is extended or adjusted under 35 U.S.C. 154(b) by 36 days.

(21) Appl. No.: 11/125,238

(22) Filed: May 10, 2005

(65) Prior Publication Data

US 2005/0268884 A1 Dec. 8, 2005

(30) Foreign Application Priority Data

Jun. 4, 2004 (JP) ..... 2004-166648

(51) Int. Cl.
*F01M 3/04* (2006.01)
*F01M 3/00* (2006.01)

(52) U.S. Cl. ..... 123/196 R; 123/299; 123/572

(58) Field of Classification Search ..... 123/196 R, 123/299, 572, 573, 574; 73/118.1; 436/60
See application file for complete search history.

(56) References Cited

U.S. PATENT DOCUMENTS 4,847,768 A * 7/1989 Schwartz et al. ..... 701/30
4,862,860 A * 9/1989 Shinohara ..... 123/572
5,241,937 A * 9/1993 Kanehiro et al. ..... 123/406.27
5,945,596 A 8/1999 Burkel et al.
6,966,304 B1 * 11/2005 Nagaishi et al. ..... 123/480
7,063,070 B1 * 6/2006 Mashiki ..... 123/431

FOREIGN PATENT DOCUMENTS

JP 02004197591 A * 7/2004

* cited by examiner

*Primary Examiner*—Mahmoud Gimie
(74) *Attorney, Agent, or Firm*—Global IP Counselors, LLP

(57) ABSTRACT

A diesel engine oil dilution managing device is configured to act as an oil dilution detecting device to determine if a premature combustion occurred before fuel injection by an injector based on an engine parameter that correlates with an occurrence of the premature combustion, such as an amount of time required for the crankshaft to rotate per unit crank angle or a rotational speed change rate of the crankshaft. Moreover, the diesel engine oil dilution managing device can have an engine output control section that is configured to suppress the production of output power by the engine when it is determined that the premature combustion occurred before the fuel injection by, for example, driving a throttle valve in a close direction.

19 Claims, 6 Drawing Sheets

DIESEL ENGINE OIL DILUTION MANAGING DEVICE

CROSS-REFERENCE TO RELATED APPLICATIONS

This application claims priority to Japanese Patent Application No. 2004-166648. The entire disclosure of Japanese Patent Application No. 2004-166648 is hereby incorporated herein by reference.

BACKGROUND OF THE INVENTION

1. Field of the Invention

The present invention relates to a diesel engine oil dilution managing device for a diesel engine that detects dilution of the engine oil by fuel. More specifically, the present invention relates to a technology utilized in a diesel engine, which is configured and arranged to recirculate blow-by gas to the cylinders, to detect dilution of the engine oil by fuel and to prevent unintended acceleration (i.e., unintended by the driver) resulting from the dilution of the oil.

2. Background Information

In a conventional diesel engine, blow-by gas that leaks from the combustion chamber through the piston rings is directed to an oil separator, which liquefies the engine oil in the blow-by gas to separate the engine oil from the blow-by gas. Then, the liquified oil is returned to the oil pan and the remaining blow-by gas, which contains unburned fuel, is recirculated to the cylinders and combusted again. Thus, in such conventional diesel engine, an amount of unburned fuel released to the atmosphere from the diesel engine can be reduced.

Moreover, as disclosed in Japanese PCT Publication No. H10-510028, the conventional diesel engine can be provided with a knocking sensor so that the output of the knocking sensor is used to monitor the conditions inside the cylinders after the fuel is injected.

In view of the above, it will be apparent to those skilled in the art from this disclosure that there exists a need for an improved diesel engine oil dilution managing device. This invention addresses this need in the art as well as other needs, which will become apparent to those skilled in the art from this disclosure.

SUMMARY OF THE INVENTION

In recent years, in response to the demand for optimized combustion and appropriate exhaust gas treatment, new technology for diesel engines has been developed in which the fuel injection during each cycle is divided into a plurality of injections including a main fuel injection for producing output power and an auxiliary fuel injection executed before or after the main fuel injection. Examples of typical types of the auxiliary fuel injections include a pilot injection, which is executed before the main fuel injection to improve the initial combustion, and a post fuel injection, which is executed after the main injection to increase the exhaust gas temperature. These auxiliary fuel injections are executed at timings that are offset to the advanced side or the retarded side of the timing that is optimum in view of the combustion conditions or characteristics of the engine. Consequently, the fuel injected with the auxiliary injections tends to stick readily to the wall surface of the cylinder. The fuel that sticks to the wall surface of the cylinder is mixed with the engine oil which results in dilution of the engine oil by the fuel.

If the dilution of the engine oil by the fuel becomes excessive, then the engine oil having a high fuel content will be circulated to the inside of the engine and the amount of unburned fuel contained in the blow-by gas will increase. On the other hand, since the mixing of the fuel into the engine oil raises the engine oil level in the oil pan, the amount of engine oil carried away by the blow-by gas increases. In a diesel engine, if blow-by gas containing a large amount of unburned fuel is recirculated into the cylinder, combustion of the unburned fuel will occur before fuel is injected from the injector, possibly causing exhaust emissions to worsen and knocking to occur.

In the conventional, general-purpose diesel engine disclosed in the above mentioned reference, the conditions inside the cylinder after the fuel is injected are monitored with the knocking sensor as explained above. However, the conditions that exist in the cylinder before the fuel is injected are not monitored in such conventional diesel engine. Furthermore, the above mentioned reference does not disclose an arrangement for detecting dilution of the engine oil by fuel.

One object of the present invention is to detect whether the engine oil in a diesel engine, which is configured to recirculate blow-by gas to the cylinder, is diluted with fuel and to prevent the degradation of exhaust emissions and the occurrence of knocking that can result from dilution of the engine oil by fuel.

In order to achieve the above mentioned object and other objects of the present invention, a diesel engine oil dilution managing device is provided that basically comprises an engine operation parameter detecting section, a premature combustion determining section and an oil dilution determining section. The engine operation parameter detecting section is configured to detect an engine operation parameter that correlates with an occurrence of a premature combustion before fuel injection by an injector into a cylinder. The premature combustion determining section is configured to determine whether the premature combustion occurred based on the engine operation parameter detected by the engine operation parameter detecting section. The oil dilution determining section is configured to determine that engine oil of a diesel engine is diluted with fuel when the premature combustion determining section determines that the premature combustion occurred.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
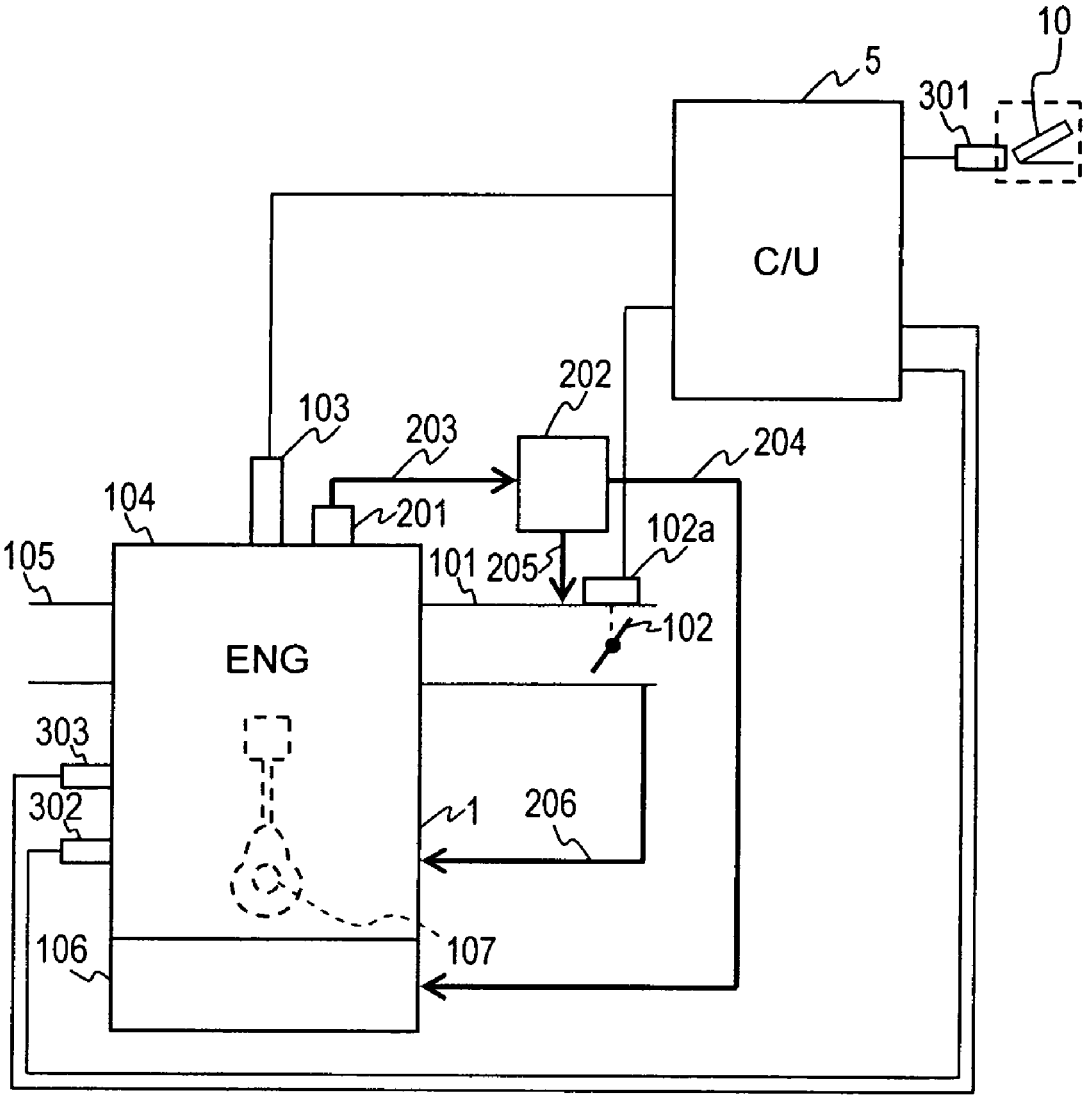
FIG. 1 is an overall schematic diagram illustrating constituent features of a diesel engine with a diesel engine oil dilution managing device that detects dilution of the engine oil by fuel and that controls the diesel engine in accordance with a first embodiment of the present invention.

Referring initially to FIG. 1, an engine control device with a diesel engine oil dilution managing device is illustrated in accordance with a first embodiment of the present invention. FIG. 1 shows the constituent features of a diesel engine 1 (hereinafter referred simply as "engine 1") in accordance with a first embodiment of the present invention. In this embodiment, the engine 1 is preferably a direct fuel injection engine. As explained below, the diesel engine oil dilution managing device of the present invention is configured and arranged to detect if the engine oil has been diluted with fuel. Moreover, the diesel engine oil dilution managing device of the present invention is configured and arranged to control the engine 1 to suppress the production of output power by the engine 1 upon determining that the engine oil is diluted with fuel. Thus, the diesel engine oil dilution managing device can be considered a diesel engine oil dilution detecting device with or without an engine output control section.

The engine 1 has an air intake passage 101 with an air cleaner (not shown) installed in the inlet section of the intake passage 101 for removing dust and particles from the intake air. Also, a throttle valve 102 is installed in the air intake passage 101 so that the cross sectional are of the air intake passage 101 is expanded or contracted by opening and closing the throttle valve 102 to control the intake air quantity. The engine 1 also comprises a control unit 5 that is configured and arranged to control an actuator 102*a* configured and arranged to open and close the throttle valve 102. The intake air quantity decreases when the actuator 102*a* drives the throttle valve 102 in a close direction. A plurality of injectors 103 (only one shown in FIG. 1) for supplying fuel are installed in a cylinder head 104 of the engine 1 such that each of the injectors 103 faces toward the approximate center of an upper portion of the combustion chamber of the respective cylinder of the engine 1. A conventional common rail fuel supply arrangement is preferably adopted in the engine 1. The control unit 5 is also configured and arranged to control operation of the injectors 103.

In this embodiment of the present invention, each of the fuel injectors 103 is preferably configured and arranged to execute a plurality of fuel injections per cycle. More specifically, in this embodiment, the fuel supplied to the engine 1 by each of the fuel injectors 103 during each cycle is divided into a main injection, a pilot injection and a post injection. The main injection is executed near top dead center of the compression stroke for the production of output power. The pilot injection is executed at a timing that is more advanced than the main injection. The post injection is executed at a timing that is more retarded than the main injection. The amount of fuel injected with the main injection is preferably adjusted in accordance with operating conditions of the engine 1 (e.g., an accelerator position APO and an engine rotational speed NE). With the pilot injection, a small amount of fuel is injected for the purpose of improving the initial combustion. The amount of fuel injected with the post injection is set in accordance with the exhaust gas treatment requirements. Moreover, although the pilot injection and the post injection are executed in this embodiment as auxiliary injections in addition to the main injection, it is also acceptable to execute such auxiliary injections as a pre-injection for shortening the delay between the execution of the main injection and the occurrence of ignition, and an after-ignition for re-combusting particulates after the main injection.

After combustion in the cylinders of the engine 1, the exhaust gas is discharged into an exhaust passage 105 from the cylinders. A diesel particulate filter (not shown) is installed in the exhaust passage 105. The diesel particulate filter contains a porous filter element that serves to capture and remove particulates from the exhaust gas. When the quantity of particulates accumulated in the filter element exceeds a prescribed quantity, the post injection is executed to increase the temperature of the exhaust gas and combust the accumulated particulates in the filter element, thereby regenerating the diesel particulate filter.

The engine 1 is provided with a mechanism for recirculating blow-by gas, which leaks out from the cylinders to the crankcase, back to the cylinders. This mechanism basically comprises a pressure control valve 201 mounted to the cylinder head 104 and an oil separator 202 configured to separate the oil from the blow-by gas by liquefying the oil. As seen in FIG. 1, the pressure control valve 201 and the oil separator 202 are connected together through a first blow-by gas passage 203. The oil separator 202 and the oil pan 106 are connected together through an oil pan return passage 204. The oil separator 202 and the air intake passage 101 (in this embodiment, a surge tank installed downstream of the throttle valve 102) are connected together through a second blow-by gas passage 205. Consequently, the blow-by gas inside the crankcase is drawn into the blow-by gas passage 203 at a flow rate restricted by the pressure control valve 201 and flows into the oil separator 202. In the oil separator 202, the oil is separated from the blow-by gas. The liquid oil separated from the blow-by gas is returned to the oil pan 106 through the oil return passage 204. After exiting the oil separator 202, the blow-by gas is drawn into the air intake passage 101 through the second blow-by gas passage 205 and treated by being combusted in the engine 1. In this embodiment, the inside of the crankcase and the portion of the air intake passage 101 that is farther upstream than the throttle valve 102 are linked together by an air introduction passage 206 so that when blow-by gas is treated, scavenging air is introduced into the crankcase from the air intake passage 101 and flushes the air and fumes inside the crankcase.

As seen in FIG. 1, the engine 1 is provided with various sensors for detecting the operating conditions of the engine 1 such as an accelerator sensor 301, a crank angle sensor 302, and a coolant temperature sensor 303. The accelerator sensor 301 is configured and arranged to detect an accelerator position APO of an accelerator 10 and output signals indicative of the acceleration position APO to the control unit 5. The crank angle sensor 302 is configured and arranged to detect a unit crank angle and a reference crank angle of a crankshaft 107 and output signals indicative of the unit crank angle and the reference crank angle of the crankshaft 107 to the control unit 5. The coolant temperature sensor 303 is configured and arranged to detect a coolant temperature Tw and output signals indicative of the coolant temperature Tw to the control unit 5. The control unit 5 is configured and arranged to execute control of the injectors 103 for the normal state of the engine 1 based on these input signals. Moreover, the control unit 5 is also configured and arranged to execute control of the throttle valve 102 as described in detail later when the engine oil is diluted.

The control unit 5 preferably includes a microcomputer with an oil dilution detection control program and engine control program that control the operations of the engine 1 as discussed below. The control unit 5 can also include other conventional components such as an input interface circuit, an output interface circuit, and storage devices such as a ROM (Read Only Memory) device and a RAM (Random Access Memory) device. The microcomputer of the control unit 5 is programmed to control the injectors 103, the throttle valve 102 and various other components of the engine 1. The memory circuit stores processing results and control programs such as ones for the oil dilution detecting operation that are run by the processor circuit. The control unit 5 is operatively coupled to the injectors 103, the throttle valve 102, the sensors and various other components in a conventional manner. The internal RAM of the control unit 5 stores statuses of operational flags and various control data. The internal ROM of the control unit 5 stores the prescribed data such as maps and tables for various operations. The control unit 5 is capable of selectively controlling any of the components of the control system of the engine 1 in accordance with the control program. It will be apparent to those skilled in the art from this disclosure that the precise structure and algorithms for the control unit 5 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

More specifically, in this embodiment, the control unit 5 preferably constitutes an engine operation parameter detecting section, a premature combustion determining section, an oil dilution determining section, an injection control section, a requested load detecting section and an oil suppression prohibiting section of the present invention. In other words, the control unit 5 is configured and arranged to function as the diesel engine oil dilution managing device that can be considered a diesel engine oil dilution detecting device with or without an engine output control section of this embodiment. Moreover, the control unit 5 is also configured to execute control of the engine 1 to achieve the output power corresponding to the accelerator position APO when engine operating conditions are normal and control to suppress the production of output power by the engine 1 when it is detected that the engine oil is diluted with fuel. In other words, the control unit 5 can be considered an engine output control section configured to control operations of the engine 1 to suppress production of output power upon that the engine oil is diluted with fuel.

As explained above, in this embodiment, the control unit 5 is configured to control the injectors 103 to execute the pilot injection and the post injection in addition to the main injection. Moreover, the control unit 5 is configured to execute these auxiliary fuel injections (i.e., the pilot injection and the post injection) at timings that are offset to the advanced side or the retarded side of the timing that is optimum in view of the combustion characteristics of the engine 1. Thus, the fuel injected with the auxiliary injections tends to stick readily to the wall surfaces of the cylinders. The fuel that sticks to the wall surfaces mixes with the engine oil and dilutes the engine oil.

Thus, with the oil dilution managing (detecting) device of the present invention, dilution of the engine oil by fuel in the engine 1 is detected in a simple manner by detecting premature combustion occurring before the fuel is injected from the injector 103 based on an engine operating parameter that correlates with an occurrence of the premature combustion before fuel injection by the injector 103. In the first embodiment of the present invention, an amount of time required for the crankshaft 107 to rotate per unit crank angle is detected as the engine operation parameter that correlates with the occurrence of the premature combustion. Also, with the present invention, the control unit 5 is configured to execute control that suppresses the production of output power by the engine 1 when it is detected that the engine oil is diluted with fuel. Thus, degradation of the exhaust emissions resulting from dilution of the engine oil can be avoided.

Figure 2:
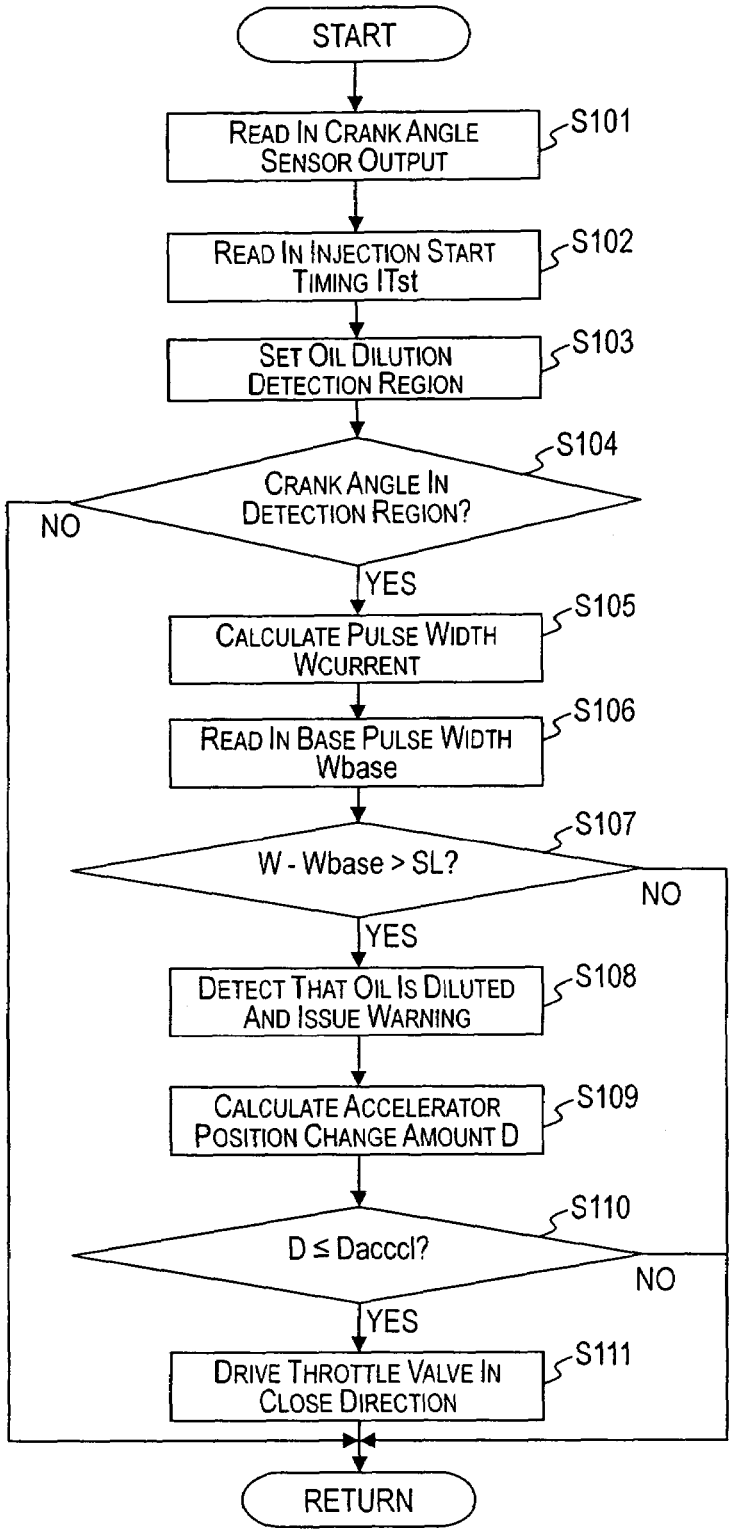
FIG. 2 is a flowchart for explaining a control process for detecting oil dilution and controlling engine operation executed by the diesel engine oil dilution managing device in accordance with the first embodiment of the present invention.

FIG. 2 is a flowchart of a control process for detecting oil dilution and controlling engine operation executed by the control unit 5. This routine is preferably executed once per prescribed amount of time.

In step S101, the control unit 5 is configured to read in the output signal of the crank angle sensor 302. In this embodiment, the output signal of the crank angle sensor 302 is a unit crank angle position detection signal outputted once per unit crank angle (e.g., every 10°).

In step S102, the control unit 5 is configured to read in the injection start timing ITst. In a case where a plurality of fuel injections is executed per cycle as in this embodiment, the start timing for the injection that is executed earliest among the plurality of fuel injections is read in as the injection start timing ITst. In this embodiment, since the fuel is injected with three separate injections (i.e., the pilot injection, the main injection and the post injection), the injection start timing ITst is set to the starting timing of the pilot injection.

In step S103, the control unit 5 is configured to set an oil dilution detection region. The oil dilution detection region is a monitoring period for detecting if the engine oil is diluted with fuel. In this embodiment, the oil dilution detection region is preferably set based on the crank angle as the period from the start of the compression stroke (i.e., 180° before top dead center of the compression stroke) until the injection start timing ITst.

In step S104, the control unit 5 is configured to determine if the current crank angle position is in the oil dilution detection region. If the current crank angle position is determined to be in the oil dilution detection region (Yes in step S104), the control unit 5 is configured to proceed to step S105. If the current crank angle position is determined to be not in the oil dilution detection region (No in step S104), the control unit 5 is configured to end the routine and return.

In step S105, the control unit 5 is configured to calculate the period the output pulse (hereinafter referred as pulse width) Wcurrent from the crank angle sensor 302 (see FIG. 5).

Figure 3:
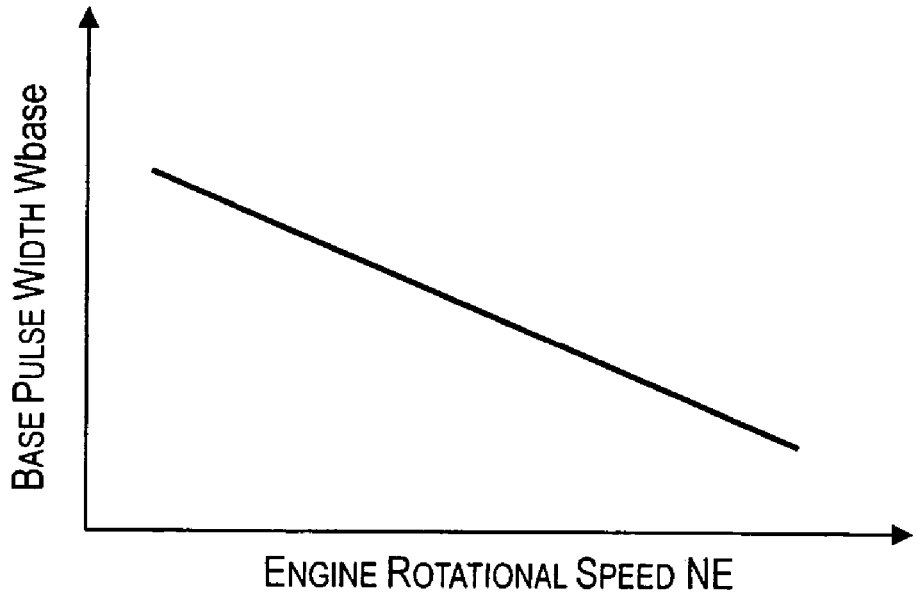
FIG. 3 is a simplified diagrammatic view of a table illustrating a relationship between base pulse width versus engine rotational speed used in the diesel engine oil dilution managing device in accordance with the first embodiment of the present invention.

In step S106, the control unit 5 is configured to read in the normal pulse width (hereinafter called "base pulse width") Wbase corresponding to a reference pulse width of the current operating condition under the normal conditions (i.e., when the engine oil is not diluted with fuel). The base pulse width Wbase is preferably read from a prescribed table such as one shown in FIG. 3. In the table shown in FIG. 3, the base pulse width Wbase is plotted with respect to the engine rotational speed NE such that the higher the engine speed NE, the smaller the value to which the base pulse width Wbase is set. The engine speed NE is preferably detected as an average rotational speed per cycle based on the output of the crank angle sensor 302 using a separately executed engine rotational speed detecting routine. Any conventional engine rotational speed detecting routine can be utilized to detect the engine rotational speed NE based on the output of the crank angle sensor 302.

In step S107, the control unit 5 is configured to determine whether the difference between the pulse width Wcurrent and the base pulse width Wbase (i.e., Wcurrent−Wbase) is larger than a prescribed dilution determination value SL. In other words, the control unit 5 is configured to determine if the pulse width Wcurrent has been extended from the base pulse width Wbase by an amount that exceeds an allowable range, the allowable range being defined such that the dilution determination value SL is the upper limit thereof.

Figure 4:
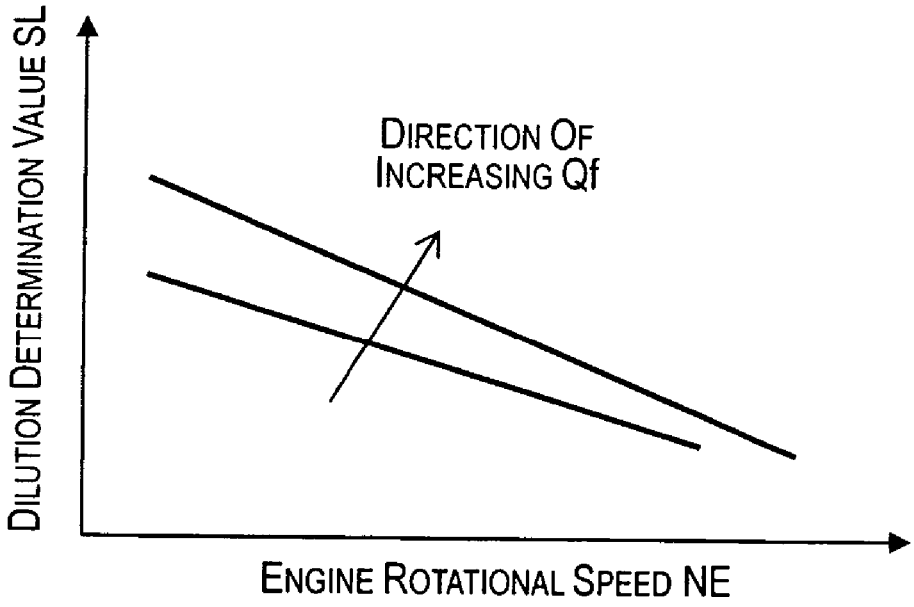
FIG. 4 is a simplified diagrammatic view of a table used for obtaining a dilution detection value for detecting oil dilution based on the pulse width of an output signal from a crank angel sensor in the diesel engine oil dilution managing device in accordance with the first embodiment of the present invention.

The dilution determination value SL is read from a prescribed table such as one shown in FIG. 4. In the table shown in FIG. 4, the dilution determination value SL is plotted with respect to the engine rotational speed NE and a fuel injection quantity Qf, which corresponds to the engine load, such that the higher the rotational speed NE and the smaller the load, the smaller the value to which the dilution determination value SL is set. In this embodiment of the present invention, the fuel injection quantity Qf is determined based on the fuel quantity injected with the main injection. If the difference between the pulse width Wcurrent and the base pulse width Wbase (i.e., Wcurrent−Wbase) is larger than the dilution determination value SL in step S107, the control unit 5 is configured to proceed to step S108. On the other hand, if the difference between the pulse width Wcurrent and the base pulse width Wbase is not larger than the dilution determination value SL in step S107, the control unit 5 is configured to end the routine and return.

In step S108, the control unit 5 is configured to determine that unintended or premature combustion is occurring before the fuel is injected from the injector 103, i.e., that the engine oil is diluted with fuel, and illuminate a warning light or the like to inform a driver that the engine oil needs to be changed.

In step S109, the control unit 5 is configured to calculate an accelerator position change amount D (i.e., the amount of change in the load) that corresponds to a change in the load requested by the driver for the engine 1. The accelerator position change amount D is calculated as the difference between the accelerator position $APO_n$ of the accelerator 10 detected by the accelerator sensor 301 in the current control cycle and the accelerator position $APO_{n-1}$ detected by the accelerator sensor 301 in the previous control cycle (i.e., $APO_n - APO_{n-1}$).

In step S110, the control unit 5 is configured to determine if the accelerator position change amount D is less than or equal to a prescribed threshold value Dacc. If the accelerator position change amount D is less than or equal to the prescribed threshold value Dacc in step S110, the control unit 5 is configured to proceed to step S111 where the control unit 5 is configured to execute an operation of the engine 1 to suppress the production of the output power. If the accelerator position change amount D is larger than the prescribed threshold value Dacc, the control unit 5 is configured to end the routine and return. Step S110 is provided in order to prevent the degradation of driving performance which would result if control that suppresses engine output (described in detail later) were executed while the driver was accelerating the vehicle.

In step S111, the control unit 5 is configured to drive the throttle valve 102 in the close direction to suppress the production of output power by the engine 1. Since the control for suppressing the production of output power by the engine 1 is executed in step S1 when it is detected that the engine oil is diluted with fuel 11, degradation of the exhaust emissions resulting from dilution of the engine oil can be avoided.

Figure 5:
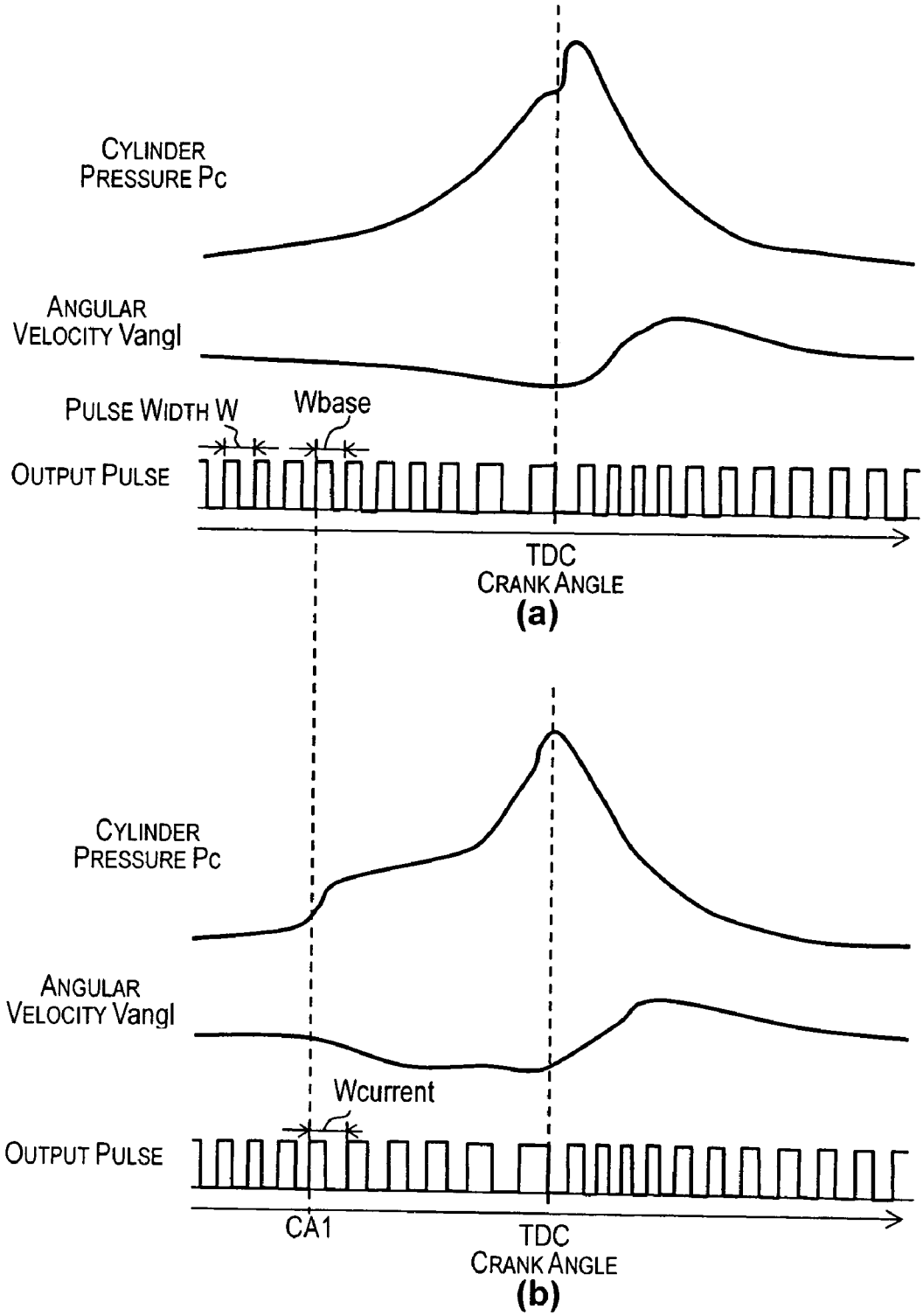
FIG. 5 is a schematic diagram illustrating a relationship between a cylinder pressure, a crank shaft angular velocity, and an output pulse of the crank angle sensor during the period before and after top dead center of the compression stroke under normal conditions and conditions of diluted engine oil.

FIG. 5 is a schematic diagram that conceptually illustrates a cylinder pressure Pc, a crank shaft angular velocity Vangl, and the output pulse of the crank angle sensor 302 during the period before and after top dead center TDC of the compression stroke. A diagram (a) of FIG. 5 illustrates normal conditions of the engine 1 and a diagram (b) of FIG. 5 illustrates the conditions of the engine 1 when the engine oil is diluted.

During normal conditions as shown in the diagram (a) of FIG. 5, the period of the output pulse, i.e., the pulse width W, lengthens gradually as the cylinder pressure Pc increases. After the fuel is injected from the injector 103, the cylinder pressure Pc rises sharply due to combustion and the pulse width W shortens. After the crank angle passes the top dead center TDC, the pulse width W lengthens again as the cylinder pressure Pc decreases. Thus, the angular velocity Vangl follows a repeating cycle of decreasing gradually before the fuel is injected, increasing sharply due to the combustion, and then gradually decreasing again. Conversely, when the oil is diluted by fuel as shown in the diagram (b) of FIG. 5, the fuel contained in the blow-by gas combusts at the timing CA1 during the compression stroke before the fuel is injected from the injector 103. This unintended, premature combustion before the fuel injection by the injector 103 retards the rotation of the crankshaft 107 by causing a torque oriented in the opposite direction of the forward rotation to be generated. As a result, the pulse width Wcurrent lengthens and the angular velocity Vangl decreases rapidly as shown in the diagram (b) of FIG. 5. As explained above, in this embodiment, the occurrence of the premature combustion before the fuel injection is detected based on the change in the pulse width W from the normal value (i.e., Wbase−Wcurrent). Since it is assumed in the present invention that the premature combustion occurring before the fuel is injected by the injector 103 is caused by dilution of the engine oil, the control unit 5 is configured to determine that engine oil is diluted when the occurrence of the premature combustion is detected.

In this embodiment, steps S101 and S105 of the flowchart shown in FIG. 2 constitute the engine operation parameter detecting section, steps S102 to S104, S106, and S107 constitute the premature combustion determining section, and step S108 constitutes the oil dilution determining section. Also, step S11 of the flowchart shown in FIG. 2 constitutes the engine output control section, step S109 constitutes the requested load detecting section, and S110 constitutes the output suppression prohibiting section.

Accordingly, with the first embodiment of the present invention, the control unit 5 is configured to detect if the engine oil in the engine 1 has become diluted with fuel by detecting if premature combustion is occurring before fuel is injected from the injectors 103. Moreover, the occurrence of premature combustion is detected based on the change in the pulse width W. As a result, dilution of the engine oil by fuel can be detected in a simple manner.

Moreover, when the control unit 5 detects that the engine oil is diluted with fuel, the engine control device (i.e., the control unit 5) of the first embodiment is configured to execute control to suppress the production of output power by the engine 1. As a result, the premature combustion of the fuel in the blow-by gas can be prevented from continuing until the regular intended combustion timing or causing the regular intended combustion to become excessively active. Thus, degradation of the exhaust emissions and the occurrence of knocking can be avoided.

Furthermore, this embodiment of the present invention is configured to calculate the accelerator position change amount D and only execute control for suppressing the output of the engine if the vehicle is not being accelerated (i.e., if the accelerator position change amount D is equal to or less than the threshold value Dacc). As a result, situations in which the driving performance declines because the engine output is suppressed during acceleration can be avoided.

Second Embodiment

Figure 6:
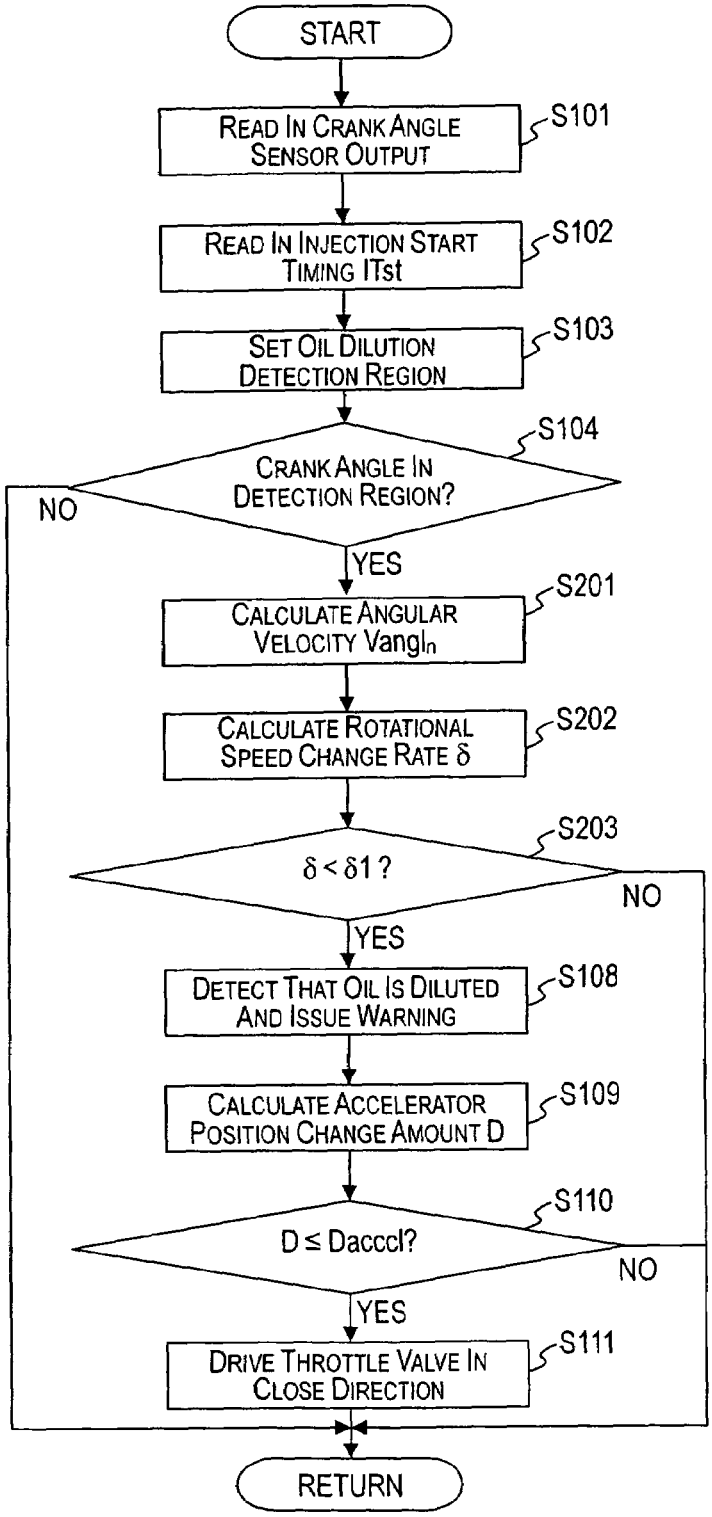
FIG. 6 is a flowchart for explaining a control process for detecting oil dilution and controlling engine operation executed in a diesel engine oil dilution managing device in accordance with a second embodiment of the present invention.
Figure 7:
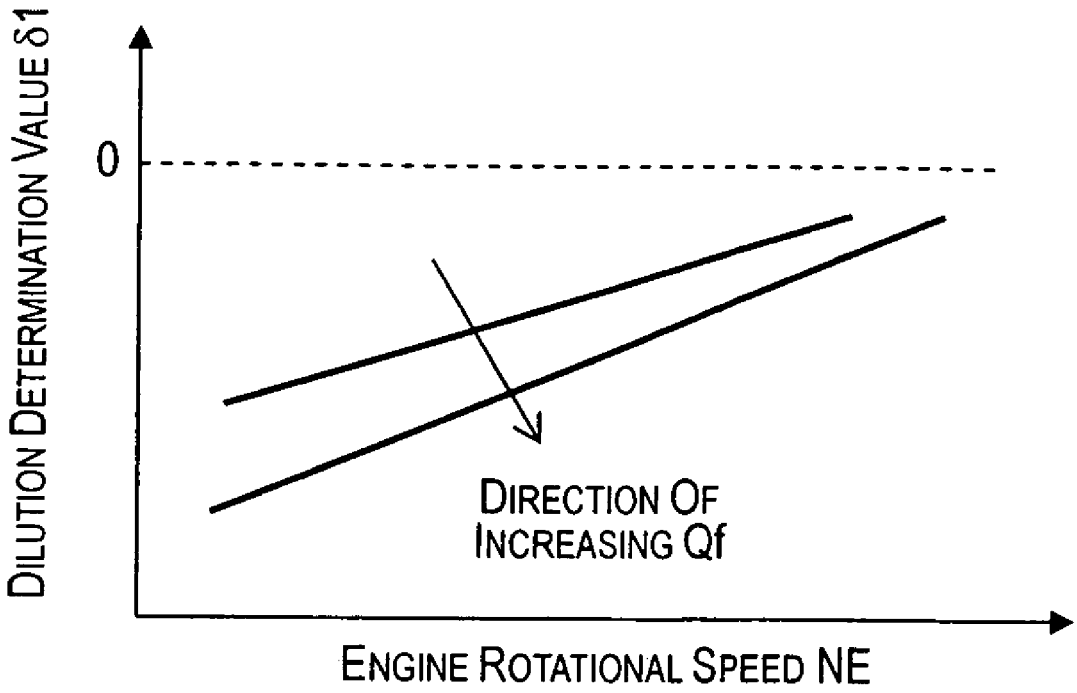
FIG. 7 is a simplified diagrammatic view of a table used for obtaining a dilution detection value for detecting oil dilution based on a rotation change rate in accordance with the second embodiment of the present invention.

Referring now to FIGS. 6 and 7, a diesel engine oil dilution managing (detecting) device in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The diesel engine oil dilution managing device of the second embodiment is basically identical to the first embodiment, except for the control routine for detecting the oil dilution. In other words, the oil dilution managing device of the second embodiment can be applied to the diesel engine 1 in the first embodiment as shown in FIG. 1. More specifically, the second embodiment of the present invention defers from the first embodiment of the present invention only in that the control unit 5 is configured to execute a control process illustrated in the flowchart of FIG. 6 for detecting the oil dilution instead of the control process shown in FIG. 2.

FIG. 6 is a flowchart of the oil dilution detecting routine used in the second embodiment of the present invention. In the second embodiment too, the control process for detecting the oil dilution and for operating the engine 1 as shown in FIG. 6 is preferably executed by the control unit 5 once per prescribed amount of time. In the flowchart shown in FIG. 6, steps that are identical to the steps of the first embodiment shown in FIG. 2 are assigned the same reference numerals.

In steps S101 to S104, the control unit 5 is configured to read in the output of the crank angle sensor 302, and proceed to step S201 if the control unit 5 determines that the current crank angle position is within the oil dilution detection region as explained above with referring to FIG. 2.

In step S201, the control unit 5 is configured to detect the period of the output pulse of the crank angle sensor 302 and calculate an angular velocity $Vangl_n$ of the crankshaft 107 based on the detected period.

In step S202, the control unit 5 is configured to subtract the angular velocity $Vangl_{n-1}$ calculated in the previous control cycle from the angular velocity $Vangl_n$ calculated in the current control cycle (i.e., $Vangl_n - Vangl_{n-1}$) to obtain a rotational speed change rate δ, i.e., the change in rotation per period of the output pulse from the crank angle sensor 302.

In step S203, the control unit 5 is configured to determine if the rotational speed change rate δ is smaller than a prescribed dilution determination value δ1. The dilution determination value δ1 is preferably read from a prescribed table such as one shown in FIG. 7. The dilution determination value δ1 is plotted as a negative value with respect to the engine rotational speed NE and the fuel injection quantity Qf such that the higher the rotational speed NE and the smaller the load, the smaller the absolute value of the value to which the dilution determination value δ1 is set. If the rotational speed change rate δ is smaller than the dilution determination value δ1 (Yes in step S203), the control unit 5 is configured to proceed to step S108. If the rotational speed change rate δ is not smaller than the dilution determination value δ1 (No in step S203), the control unit 5 is configured to end the routine and return.

In step S108 and subsequent steps, the control unit 5 is configured to determine that the engine oil is diluted by fuel and issue a warning to the driver. Then, so long as the vehicle is not being accelerated, the control unit 5 is configured to drive the throttle valve 102 in the close direction to suppress the production of output power by the engine 1 as explained above with referring to FIG. 2.

In the second embodiment, steps S101, S201 and S202 of the flowchart shown in FIG. 6 constitute the engine operation parameter detecting section, step S203 constitutes the premature combustion determining section, and step S108 constitutes the oil dilution determining section. Moreover, step S111 of the flowchart shown in FIG. 6 constitutes the engine operation control section, step S109 constitutes the required load detecting section, and S110 constitutes the output suppression prohibiting section.

The effects that can be obtained with the second embodiment are basically the same as those that can be obtained with the first embodiment of the present invention explained above. More specifically, with the second embodiment, dilution of the engine oil by fuel can be detected in a simple manner based on the rotational speed change rate δ. When dilution of the oil is detected, degradation of the exhaust emissions and the occurrence of knocking can be avoided by executing control to suppress the output of the engine 1. Additionally, the driving performance of the vehicle can be ensured by prohibiting the engine output suppression control when the vehicle is being accelerated.

In the embodiments described herein, an engine operation parameter is detected in order to detect if unintended or premature combustion is occurring before the intended combustion (i.e., combustion of the fuel injected by the injector 103). In the present invention, the occurrence of the premature combustion is assumed to be caused by dilution of the engine oil by fuel. In the first embodiment of the present invention, the period W of the output signal of the crank angle sensor 302 (i.e., the amount of time required for the crankshaft 107 to rotate per unit crank angle) is detected as the engine operation parameter. In the second embodiment of the present invention, the rotational speed change rate δ which correlates with the amount of time required for the crankshaft 107 to rotate per unit crank angle is detected as the engine operation parameter that correlates with the occurrence of premature combustion.

In the present invention, it is also acceptable to use the cylinder pressure as the engine operation parameter for detecting the premature combustion. More specifically, a pressure sensor configured to detect the cylinder pressure or a knocking sensor configured to react to combustion vibrations can be provided with the engine 1 and the output of the sensor can be used to detect if the premature combustion is occurring before fuel is injected from the injector 103. The engine control device can then be configured such that, when the premature combustion before fuel injection is detected, the engine control device determines that the engine oil is diluted with fuel, illuminate a warning lamp or otherwise issue a warning, and control the engine in accordance with the detection result.

Additionally, in the embodiments described herein, the throttle valve 102 is driven in the close direction to reduce the intake air quantity to suppress the production of output power by the engine 1 when it is detected that the engine oil is diluted with oil. However, it will be obvious to one skilled in the art from this disclosure that it is also acceptable to use another method of suppressing the engine output. For example, the control unit 5 can be configured to stop or suspend the injection of fuel by the injectors 103 to suppress the production of the output by the engine 1.

As used herein to describe the above embodiments, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The term "detect" as used herein to describe an operation or function carried out by a component, a section, a device or the like includes a component, a section, a device or the like that does not require physical detection, but rather includes determining or computing or the like to carry out the operation or function. The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A diesel engine oil dilution managing device comprising:

an engine operation parameter detecting section configured to detect an engine operation parameter that correlates with an occurrence of a premature combustion before fuel injection by an injector into a cylinder;

a premature combustion determining section configured to determine whether the premature combustion occurred based on the engine operation parameter detected by the engine operation parameter detecting section; and an oil dilution determining section configured to determine that engine oil of a diesel engine is diluted with fuel when the premature combustion determining section determines that the premature combustion occurred.

2. The diesel engine oil dilution managing device as recited in claim 1, wherein the engine operation parameter detecting section is configured to detect an amount of time required for a crankshaft to rotate per unit crank angle as the engine operation parameter.

3. The diesel engine oil dilution managing device as recited in claim 1, wherein the engine operation parameter detecting section is configured to detect a rotational speed change rate of a crankshaft as the engine operation parameter.

4. The diesel engine oil dilution managing device as recited in claim 1, further comprising:

an injection control section configured to control the injector to execute a plurality of fuel injections per cycle including at least a first fuel injection for producing output power and a second fuel injection executed before or after the first fuel injection.

5. The diesel engine oil dilution managing device as recited in claim 4, wherein the oil dilution determining section is configured to determine whether the premature combustion occurred before an earliest fuel injection among the plurality of fuel injections.

6. The diesel engine oil dilution managing device as recited in claim 1, wherein the oil dilution determining section is configured to determine whether the premature combustion occurred during a compression stroke before the fuel injection by the injector.

7. The diesel engine oil dilution managing device as recited in claim 1, further comprising an engine output control section configured to control operations of the diesel engine to suppress production of output power when the oil dilution determining section determines that the engine oil is diluted with fuel.

8. The diesel engine oil dilution managing device as recited in claim 7, wherein the engine operation parameter detecting section is configured to detect an amount of time required for a crankshaft to rotate per unit crank angle as the engine operation parameter.

9. The diesel engine oil dilution managing device as recited in claim 7, wherein the engine operation parameter detecting section is configured to detect a rotational speed change rate of a crankshaft as the engine operation parameter.

10. The diesel engine oil dilution managing device as recited in claim 7, further comprising:

an injection control section configured to control the injector to execute a plurality of fuel injections per cycle including at least a first fuel injection for producing output power and a second fuel injection executed before or after the first fuel injection.

11. The diesel engine oil dilution managing device as recited in claim 10, wherein the oil dilution determining section is configured to determine whether the premature combustion occurred before an earliest fuel injection among the plurality of fuel injections.

12. The diesel engine oil dilution managing device as recited in claim 7, wherein the oil dilution determining section is configured to determine whether the premature combustion occurred during a compression stroke before the fuel injection by the injector.

13. The diesel engine oil dilution detecting device as recited in claim 7, wherein the engine operation control section is configured to drive a throttle valve of the diesel engine in a close direction to reduce intake air quantity drawn into the diesel engine when the oil dilution determining section determines that the engine oil is diluted with fuel.

14. The diesel engine oil dilution managing device as recited in claim 7, wherein the engine operation control section is configured to substantially stop the fuel injection by the injector when the oil dilution determining section determines that the engine oil is diluted with fuel.

15. The diesel engine oil dilution managing as recited in claim 7, further comprising:

a requested load detecting section configured to detect a change in a load requested from the diesel engine per unit time; and an output suppression prohibiting section configured to prohibit the engine operation control section from executing control to suppress the production of the output power when an amount of the change in the load requested from the diesel engine per unit time detected by the requested load detecting section is larger than a prescribed value.

16. A diesel engine oil dilution detecting method comprising:

detecting an engine operation parameter that correlates with an occurrence of a premature combustion before fuel injection by a injector into a cylinder;

determining whether a premature combustion occurred based on the engine operation parameter; and determining that engine oil of the diesel engine is diluted with fuel when it is determined the premature combustion occurred.

17. The diesel engine oil dilution detecting method as recited in claim 16, wherein the detecting of the engine operation parameter is performed by detecting an amount of time required for a crankshaft to rotate per unit crank angle.

18. The diesel engine oil dilution detecting device as recited in claim 16, wherein the detecting of the engine operation parameter is performed by detecting a rotational speed change rate of a crankshaft.

19. A diesel engine oil dilution managing device comprising:

engine operation parameter detecting means for detecting an engine operation parameter that correlates with an occurrence of a premature combustion before fuel injection by a injector into a cylinder;

premature combustion determining means for determining whether a premature combustion occurred based on the engine operation parameter detected by the engine operation parameter detecting means; and oil dilution determining means for determining that engine oil of a diesel engine is diluted with fuel when the premature combustion determining means determines that the premature combustion occurred.

* * * * *